US006225277B1

(12) United States Patent
Gordon

(10) Patent No.: US 6,225,277 B1
(45) Date of Patent: May 1, 2001

(54) HARD SURFACE CLEANING COMPOSITIONS

(75) Inventor: Neil James Gordon, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/202,034

(22) PCT Filed: Oct. 1, 1996

(86) PCT No.: PCT/US96/15644

§ 371 Date: Apr. 9, 1998

§ 102(e) Date: Apr. 9, 1998

(87) PCT Pub. No.: WO97/13836

PCT Pub. Date: Apr. 17, 1997

(30) Foreign Application Priority Data

Oct. 9, 1995 (EP) ..... 95870113

(51) Int. Cl.[7] ..... C11D 17/00

(52) U.S. Cl. ..... 510/475; 510/181; 510/427; 510/434; 510/490

(58) Field of Search ..... 510/181, 427, 510/434, 475, 490

(56) References Cited

U.S. PATENT DOCUMENTS 5,254,290 * 10/1993 Blandiaux et al. ..... 252/545
5,389,284 * 2/1995 Van Der Hoeven et al. .. 252/174.22
5,534,198 * 7/1996 Masters et al. ..... 510/182

* cited by examiner

*Primary Examiner*—Necholus Ogden
(74) *Attorney, Agent, or Firm*—Jason J. Camp

(57) ABSTRACT

Hard surface cleaning compositions are disclosed which provide gloss to the surfaces cleaned therewith. The compositions comprise an anionic surfactant, a nonionic surfactant, a perfume and a sulphonated polystyrene. Preferred compositions additionally comprise an aminophosphonate chelating agent.

11 Claims, No Drawings

HARD SURFACE CLEANING COMPOSITIONS

TECHNICAL FIELD

The present invention relates to compositions for cleaning hard surfaces.

BACKGROUND

A variety of compositions for cleaning hard surfaces have been disclosed in the art. Much of the focus for such compositions has been on providing outstanding cleaning on a variety of surfaces and soils. For some specialised cleaners, such as glass cleaners, much effort has additionally been devoted to the formulation of so-called "streak-free" products, i.e. products which leave no or little visible residues after use.

The object of the present invention is to formulate hard surface cleaning compositions which clean and provide gloss to the cleaned surface. That is different from a "streak-free" composition, in that gloss additionally requires improved reflectance of light from the cleaned surface. A variety of products are commercially available for delivering gloss to surfaces, and they are disclosed for instance in U.S. Pat. No. 3,960,575 and U.S. Pat. No. 4,218,250. Both references recommend the use of various silicones for delivering gloss. Such compositions are not fully formulated hard surface cleaners, so that they do not clean efficiently, and indeed the formulation of silicone in hard surface cleaners has not shown any gloss benefits. See for instance EP 374 471 which discloses a hard surface cleaning composition with, amongst other essentials, a silicone for improved resistance to soil redeposition.

We have now found that superior gloss on surface can be obtained from a hard surface cleaning composition comprising a sulphonated homopolymer of (poly) styrene or a sulphonated copolymer of styrene with an ethylenically unsaturated comonomer, or mixtures of said polymers.

Suitable Polystyrenes sulphonates for use herein are disclosed for instance in "Multifunctional Sulphonated Polymers for Household Applications", J. Guth et Al. Happi, December '94. The Guth article mentions that the key benefit of such polymers in the context of hard surface cleaners is anti soil redeposition, but does not discuss gloss.

SUMMARY OF THE INVENTION

In one embodiment, the present invention encompasses a hard surface cleaning composition comprising an anionic surfactant, a nonionic surfactant, a perfume and a sulphonated (poly) styrene or a sulphonated copolymer of styrene with an ethylenically unsaturated comonomer, or mixtures of said polymers.

In a second embodiment, the present invention encompasses a process of cleaning a hard surface by applying on said surface an effective amount of a composition defined herein.

In a third embodiment, the present invention encompasses the use of a sulphonated homopolymer of (poly) styrene or a sulphonated copolymer of styrene with an ethylenically unsaturated comonomer, or mixtures of said polymers, in a hard surface cleaning composition, for providing gloss to the surfaces being cleaned with said compositions.

DETAILED DESCRIPTION OF THE INVENTION

The compositions herein are hard surface cleaning compositions. The compositions can thus be formulated either as solids or liquids, but are used in a liquid form to ensure even delivery of the polymer, as a layer, onto the surface being cleaned. In the case where the compositions are formulated as solids, they will thus be mixed with an appropriate solvent, typically water, before use. In liquid form, the compositions are preferably but not necessarily formulated as aqueous compositions.

As a first essential ingredient, the compositions herein comprise a sulphonated homopolymer of (poly) styrene, or a sulphonated copolymer of styrene with an ethylenically unsaturated comonomer. The polymers are present in the compositions herein in preferred amounts of up to 20.0% by weight of the total composition, most preferably 0.1% to 5.0%. It is said polymers which, upon use, is deposited on the surface being cleaned, which provides the gloss benefit. Two different types of sulfonated polymers are useful herein.

The first type is a sulfonated homopolymer of styrene. The second type is a sulfonated interpolymer of styrene with an ethylenically unsaturated comonomer. The useful compounds herein include the partially or fully neutralized salts of either the sulfonated polystyrene or the sulfonated styrene interpolymers, i.e. the soluble salts of these polymers, wherein the sulfonic acid groups are partially or fully neutralized.

Suitable ethylenically unsaturated comonomer units which can be copolymerized with styrene to make the interpolymers suitable for sulfation include acrylic and methacrylic esters of aliphatic alcohols such as methyl, ethyl, butyl and 2-ethyl hexyl alcohols, acrylic acid, acrylonitrile, methacrylonitrile, dibutyl maleate, vinylidene chloride, N-vinyl pyrrolidone etc . . . Particularly preferred ethylenically unsaturated monomers for use herein include ethylene, propylene, styrene, vinyl naphthalene, acrylic acid and maleic anhydride.

Sulphonated styrene homopolymers suitable for use herein are commercially available under the trade name Versaflexe® from National Starch. Most suitable polymers and copolymers for use herein will be water soluble, and the molecular weight for these polymers is preferably between 5000 and 10,000,000, most preferably between 50,000 and 1,000,000.

As a second essential ingredient, the compositions herein comprise an anionic surfactant or mixtures thereof, preferably in amounts of up to 50% by weight of the total composition, most preferably from 0.1% to 10.0%.

Particularly preferred anionic surfactants for use herein include alkali metal (e.g., sodium or potassium) fatty acids, or soaps thereof, containing from about 8 to about 24, preferably from about 10 to about 20 carbon atoms. The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Alkali metal soaps can be made by direct saponification of fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% $C_{14}$, 29% $C_{16}$, 23% $C_{18}$, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut" is used herein it refers to fatty acid mixtures which typically have an approximate carbon chain length distribution of about 8% $C_8$, 7% $C_{10}$, 48% $C_{12}$, 17% $C_{14}$, 9% $C_{16}$, 2% $C_{18}$, 7% oleic, and 2% linoleic (the first six fatty acids listed being saturated). Other sources having similar carbon chain length distribution such as palm kernel oil and babassu oil are included with the term coconut oil.

Other suitable anionic surfactants for use herein include water-soluble salts, particularly the alkali metal salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isothionic acid and neutralized with sodium hydroxide where, for example, the fatty acids are derived from coconut oil; sodium or potassium salts of fatty acid amide of a methyle taurine in which the fatty acids, for example, are derived from coconut oil; and others known in the art, a number being specifically set forth in U.S. Pat. Nos. 2,486,921, 2,486,922 and 2,396,278, incorporated herein by reference.

As a third essential ingredient, the compositions herein comprise a nonionic surfactant or mixtures thereof, preferably in amounts of up to 50.0% by weight of the total composition, most preferably from 0.1% to 20.0%.

Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohols) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic". These compounds are formed by condensing ethylene oxide with an hydrophobic base formed by the condensation of propylene oxide with propylene glycol. The hydrophobic portion of the molecule which, of course, exhibits water-insolubility has a molecular weight of from about 1500 to 1800. The addition of polyoxyethylene radicals to this hydrophobic portion tends to increase the water-solubility of the molecule as a whole and the liquid character of the products is retained up to the point where polyoxyethylene content is about 50% of the total weight of the condensation product.

Other Suitable Nonionic Synthetic Detergents Include (i) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane, for example;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000, are satisfactory;

(iii) The condensation product of aliphatic alcohols having from 8 to 18 carbon atoms, in either straight chain or branched chain configuration, with ethylene oxide, e.g., a coconut alcohol ethylene oxide condensate having from 10 to 30 moles of ethylene oxide per mole of coconut alcohol, the coconut alcohol fraction having from 10 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl)amine oxide and tetradecyl dimethyl phosphine oxide.

The compositions herein can further comprise other surfactants, cationics, zwitterionics, and mixtures thereof. Zwitterionic detergents comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Suitable zwitterionic detergent compounds have the formula

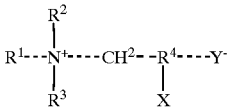

wherein $R^1$ is an alkyl radical containing from about 8 to about 22 carbon atoms, $R^2$ and $R^3$ contain from 1 to 3 carbon atoms, $R^4$ is an alkylene chain containing from 1 to about 3 carbon atoms, X is selected from the group consisting of hydrogen and a hydroxyl radical, Y is selected from the group consisting of carboxyl and sulfonyl radicals and wherein the sum of $R^1$, $R^2$ and $R^3$ radicals is from about 14 to about 24 carbon atoms.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference.

Additional synthetic detergents and listings of their commercial sources can be found in McCutcheon's Detergents and Emulsifiers, North American Ed. 1980, incorporated herein by reference.

As a fourth essential ingredient, the compositions herein comprise a perfume ingredient, or mixtures thereof, preferably in amounts of up to 5.0% by weight of the total composition, most preferably 0.1% to 1.5%.

Suitable perfumes herein include materials which provide an olfactory aesthetic benefit and/or cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the nonionic detergent surfactants.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 and above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

The compositions herein may additionally comprise a variety of other, optional, compounds. A preferred class of optional compounds are chelating agents selected from the group of aminophosphonates. Suitable amino phosphonate compounds for use herein include amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred amino phosphonate chelant to be used herein is diethylene triamine penta methylene phosphonate. Such phosphonate chelant is commercially available from Monsanto under the trade name DEQUEST®.

Chelants can be incorporated in the compositions herein in amounts ranging from 0.0% to 10.0% by weight of the total composition, preferably 0.1% to 5.0%. Aminophosphonate chelants are particularly desirable for use herein as it has been found that they further improve the gloss benefit across a wide range of water hardness conditions which may be encountered in use, most particularly during the dilution of the product prior to use. Typically, the sulphonated polystyrenes herein perform well in a range of water hardness conditions. Aminophosphonate chelants alone can provide a gloss benefit in soft water, less in hard water. But we have found that, surprisingly, the combination of sulphonated polystyrenes and aminophosphonate chelants will provide better gloss than the chelant or the sulphonated polystyrenes alone. A suitable weight ratio of chelant and polymer to observe this benefit is between 10:1 and 1:10, most preferably between 2:1 and 1:2.

The compositions herein can further comprise a variety of optimal ingredients. Suitable optimal ingredients for use herein include builders, other chelants, solvents, buffers, bactericides, enzymes, hydrotropes, colorants, stabilizers.

The present invention further encompasses a process of cleaning a hard surface by applying on said surface an effective amount of a composition defined herein. When the composition is used in a so-called concentrated form (i.e. between 10%–20% total actives), it is necessary to rinse the surface after the composition has been applied, otherwise too many visible residues are left on the surface. In this "concentrated" usage form, however, the gloss benefit provided by the polymer is still obtained after few rinses. Preferably, the composition is diluted prior to use (to reach a total active level in the order of 0.5%). In this dilute usage mode, there is no need to rinse the surface after application of the composition in order to obtain the gloss benefit.

EXAMPLES

The following compositions were made by mixing the listed ingredients in the listed proportions. All proportions are % by weight of the total compositions.

| | 1 | 2 |
|---|---|---|
| C7/C9/C11 EO6.5 | 3.0 | 00.0 |
| C12/C13 EO3 | 1.0 | 2.0 |
| C13/C15 EO21 | 2.0 | 5.0 |
| Palm Kernal Fatty Acid | 0.4 | 0.4 |
| Perfume | 0.45 | 0.45 |
| Sulfonated Polystyrene (*1) | 3.0 | 3.0 |
| Water and minors up to 100% | | |
| pH | 10.5 | 10.5 |

| | 3 | 4 |
|---|---|---|
| C7/C9/C11 EO6.5 | 3.0 | 0.0 |
| C12/C13 EO3 | 1.0 | 2.0 |
| C13/C15 EO21 | 2.0 | 5.0 |
| Sodium cumene sulfonate | 0.5 | 0.5 |
| Palm Kernal Fatty Acid | 0.4 | 0.4 |
| Perfume | 0.45 | 0.45 |
| Sulfonated Polystyrene (*1) | 3.0 | 3.0 |
| Water and Minors up to 100% | | |
| pH | 10.5 | 10.5 |

(*1) The tested polymer was a Sulfonated Polystyrene of Molecular weight 6,000,000 from Monomer-Polymer & Dajac Laboratories, INC.

| | 5 | 6 |
|---|---|---|
| C7/C9/C11 EO6.5 | 2.0 | 0.0 |
| C12/C13 EO3 | 1.0 | 1.0 |
| C13/C15 EO21 | 2.0 | 5.0 |
| Sodium alkyl benzene sulfonate | 1.0 | 1.0 |
| Palm Kernal Fatty Acid | 0.4 | 0.4 |
| Perfume | 0.45 | 0.45 |
| Sulfonated Polystyrene (*2) | 3.0 | 3.0 |
| Water and Minors up to 100% | | |
| pH | 10.5 | 10.5 |

| | 7 | 8 | 9 |
|---|---|---|---|
| C7/C9/C11 EO6.5 | 2.5 | 2.5 | 2.5 |
| C12/C13 EO3 | 1.0 | 1.0 | 1.0 |
| C13/C15 EO21 | 1.6 | 1.6 | 1.6 |
| Potassium Carbonate | 1.0 | 1.0 | 1.0 |

-continued

| | | | |
|---|---|---|---|
| Palm Kernal Fatty Acid | 00.4 | 0.4 | 0.4 |
| Sulfonated Polystyrene (*2) | 1.0 | 3.0 | 6.0 |
| Perfume | 0.45 | 0.45 | 0.45 |
| Water and Minors up to 100% | | | |
| pH | 10.5 | 10.5 | 10.5 |

| | 10 | 11 | 12 | 13 |
|---|---|---|---|---|
| Sulfonated polystyrene (*2) | 1.0 | 1.0 | 1.0 | 1.0 |
| NaCS | 1.0 | 1.0 | 1.0 | 1.0 |
| C12/C13 EO3 | 0.6 | 0.6 | 0.6 | 0.6 |
| C7/C11 EO6.5 | 1.4 | 1.4 | 1.4 | 1.4 |
| Ammonia | 0.0 | 0.1 | 0.0 | 0.0 |
| K2CO3 | 0.0 | 0.0 | 1.0 | 0.0 |
| NaOH | 0.0 | 0.0 | 0.0 | 0.1 |
| Water and Minors up to 100% | | | | |
| pH | 8.5 | 10.0 | 10.9 | 10.8 |

| | 14 |
|---|---|
| K2CO3 | 1.0 |
| C7/C11 EO6.5 | 2.5 |
| C12/C13 EO3 | 1.0 |
| C13/C15 EO30 | 1.2 |
| perfume | 0.45 |
| Poly(sodium styrene-sulfonate-co-vinyl naphthalene) | 1.0 |
| Water and Minors up to 100% | |

(*2) The tested Sulfonated Polystyrene: Versaflex 7000 (National Starch)

What is claimed is:

1. An aqueous hard surface cleaning composition comprising an anionic surfactant, a nonionic surfactant, a perfume, a sulphonated polystyrene polymer, an aminophosphonate chelant, and water.

2. A composition according to claim 1 wherein said aminophosphonate chelant is selected from the group consisting of amino alkylene poly(alkylene phosphonate), alkali metal ethane 1-hydroxy diphosphonate, nitrilo trimethylene phosphonate, ethylene diamine tetra methylene phosphonate, and diethylene triamine penta methylene phosphonate.

3. A composition according to claim 2 wherein said aminophosphonate chelant is diethylene triamine penta methylene phosphonate.

4. A composition according to claim 1 wherein a weight ratio of said aminophosphonate chelant to said sulphonated polystyrene polymer is from 10:1 to 1:10.

5. A composition according to claim 1 wherein said composition is an aqueous liquid composition.

6. A composition according to claim 1 wherein said sulphonated polystyrene polymer is a sulphonated (poly) styrene or a sulphonated copolymer of styrene with an ethylenically unsaturated comonomer, or mixtures of said polymers.

7. A composition according to claim 6 wherein said polymer is a sulphonated (poly) styrene.

8. A composition according to claim 1 wherein said polymer has a molecular weight of from about 5000 to about 10,000,000.

9. A composition according to claim 8 wherein said polymer has a molecular weight of from about 50,000 to about 1,000,000.

10. A process of providing gloss to a hard surface by applying on said surface an effective amount of a composition according to claim 1.

11. A process according to claim 10 wherein said surface is not rinsed after said composition has been applied.

* * * * *